US005626254A

United States Patent [19]

Podd et al.

[11] Patent Number: 5,626,254

[45] Date of Patent: May 6, 1997

[54] APPARATUS AND METHOD FOR RAPID INSTALLATION OF CONTAINER LINER AND ACCESS PORTS

[76] Inventors: Stephen D. Podd, 1321 Sherbrooke St. West, Apt. E1, Montreal, Quebec, Canada, H3G 1J4; Victor I. Podd, 2582 NW. 59th St., Boca Raton, Fla. 33496

[21] Appl. No.: 297,254

[22] Filed: Aug. 26, 1994

[51] Int. Cl.[6] ..... B65D 33/00

[52] U.S. Cl. ..... 220/403; 220/86.1; 220/694; 222/401; 222/567

[58] Field of Search ..... 220/470, 405, 220/694, 86.1, 403; 222/461, 567

[56] References Cited

U.S. PATENT DOCUMENTS

| | | | |
|---|---|---|---|
| Re. 29,721 | 8/1978 | Ukmar et al. | 222/105 |
| 3,462,027 | 8/1969 | Puckhaber | 214/10.5 |
| 3,559,708 | 2/1971 | Cook | 150/1 |
| 3,591,072 | 7/1971 | Sonnino | 229/62.5 |
| 3,779,420 | 12/1973 | Knaus . | |
| 4,091,957 | 5/1978 | Moller | 220/260 |
| 4,189,089 | 2/1980 | Langen et al. | 229/61 |
| 4,280,640 | 7/1981 | Daloisio | 220/407 |
| 4,287,920 | 9/1981 | Johnson, Jr. | 141/85 |
| 4,359,084 | 11/1982 | Greverath et al. | 220/1.5 |
| 4,441,627 | 4/1984 | Takeuchi | 220/461 |
| 4,486,812 | 12/1984 | Grosvenor | 383/108 |
| 4,573,508 | 3/1986 | Knaus | 150/55 |
| 4,601,405 | 7/1986 | Riener | 220/407 |
| 4,875,596 | 10/1989 | Lohse | 220/403 |
| 4,911,317 | 3/1990 | Schloesser et al. | 220/1.5 |

*Primary Examiner*—Joseph M. Moy
*Attorney, Agent, or Firm*—John C. Smith

[57] ABSTRACT

A rapid construction method and apparatus for bulk cargo containers. The system uses a flexible bag which has an open end. The sides of the bag are folded over to form an end wall and sealed together with double stick tape. Side edges are sealed to the end wall with double stick tape to form edge seals. Load, vent, or discharge ports are attached to the end wall with double stick tape. The end is opened for unloading by cutting the section of the end wall which is encircled by the port. An optional access door in the port allows manual access to remove the end wall material. The liner and ports are optionally provided in kit form with pre-attached tape on the liner and ports. The ports do not have to be attached to the liner until required.

4 Claims, 10 Drawing Sheets

Prior Art

APPARATUS AND METHOD FOR RAPID INSTALLATION OF CONTAINER LINER AND ACCESS PORTS

BACKGROUND OF THE INVENTION

1. Technical Field

The present invention relates to the loading and unloading of flowable cargo transported in lined bulk cargo containers. In particular, it relates to a method and apparatus for rapidly constructing and installing liners in a container and rapidly attaching input, vent, and discharge ports to a container.

2. Background Art

Transportation of containers for bulk commodity products (grains, etc) have been implemented using a variety transport vehicles, such as trucks, railroads, and ships. Depending on the nature of the cargo, liners may have to be installed to protect the cargo from contamination (in the case of foods or other perishables) and/or prevent leakage (in the case of powders, small particles, etc.).

An important economic factor in the transportation of bulk commodities is the speed and ease with which the commodities are loaded and unloaded from the container. One factor which effects the speed, and consequently the cost, of loading and unloading containers used for the transport of bulk commodities is the time and expense of installing the liners.

The prior art has developed several methods of installing liners. One method is the use of mechanical clamping devices to hold sections of liner material together. This method provides flexibility in terms of sizing the liner for a particular load size, but it also has several drawbacks. In particular, the liner is labor intensive to install, which increases the ultimate cost of the cargo. Likewise, it requires additional components, in the form of the clamps, which increase the total cost of the liner. In addition, a clamps failure can result in substantial leakage of cargo. Cargo leakage can not only cause economic loss due to the cargo loss itself, but depending on the nature of the cargo, there can also be substantial environmental costs due to contamination and cleanup expense.

Another prior art approach which addresses the potential leakage problem has been the development of heat sealing methods (heat seals may also be referred to herein as welds) to fuse the liner sections together. Heat sealing provides an effective seal which eliminates some of the negative aspects of clamping systems. For example, the clamps are eliminated which results in lower cost for the completed liner. Since the liner can be completely sealed, improvements in leakage avoidance may also be obtained. However, heat sealing methods also have drawbacks similar to clamping methods as well as drawbacks unique to themselves.

While the cost of clamps are eliminated by heat sealing methods, those costs may be offset by the cost of the heating equipment used to create the seals. In addition, heat sealers have the same safety hazards common to all heating devices used to create heat seals (or heat welds). A third drawback to this type of liner construction is the labor required to create the seals. The more carefully the seals are created, the higher the labor cost. On the other hand, the faster the seals are created, the greater the risk of leakage.

In addition to the construction of the liner itself, there is also the issue of how cargo load, vent, and discharge ports are incorporated into the liner. Typical prior art approaches use heat welds to construct load, vent, and discharge tubes. Of course, the same drawbacks associated with heat sealing the liners apply to heat sealing these tubes. After the tubes are constructed, they must be attached to the liner. This procedure is also usually done via heat sealing. The wall of the liner encircled by the tubes can be opened at this time or when needed. If opened immediately, the discharge tube must be tied until unloading to avoid leakage, and the load and vent tubes should be tied after loading to avoid contamination.

An alternative method of constructing the tube is to used preformed rigid tubes or rings which attach to the wall of the liner. An advantage of this approach is that it eliminates the time required to construct the tube. The disadvantage is that the preformed tubes must be attached to the liner, typically by heating.

While addressing various aspects of constructing liners and their associated load, vent, and discharge ports, the prior art has typically provided methods such as the clamping and heat sealing methods discussed above. While these methods provide effective liners, they have numerous drawbacks such as high material or equipment cost, high labor cost, safety concerns, and the possibility of leakage, environmental damage, and cargo contamination. The prior art has not provided a method of constructing liners which can be rapidly and easily installed, provides a continuous seal, and requires no special equipment. The prior art has also not provided a method of rapidly installing load, vent, and discharge tubes without special equipment or extra material. Further, the prior art has failed to provide methods of rapidly attaching materials which are incompatible or are not heat or RF sealable.

SUMMARY OF THE INVENTION

The present invention solves the foregoing problems by providing a liner which is sealed by double stick tape or two way tape. The load, vent, and discharge ports are attached to the liner wall by double stick tape. The sections of liner wall encircled by the ports are cut out prior to use. An optional access door is provided in the port to allow entry after the port is attached to a loading or unloading tube. The liner and ports can be fabricated on site, or be provided in prefabricated kit form.

DESCRIPTION OF THE PREFERRED EMBODIMENT

Figure 1:
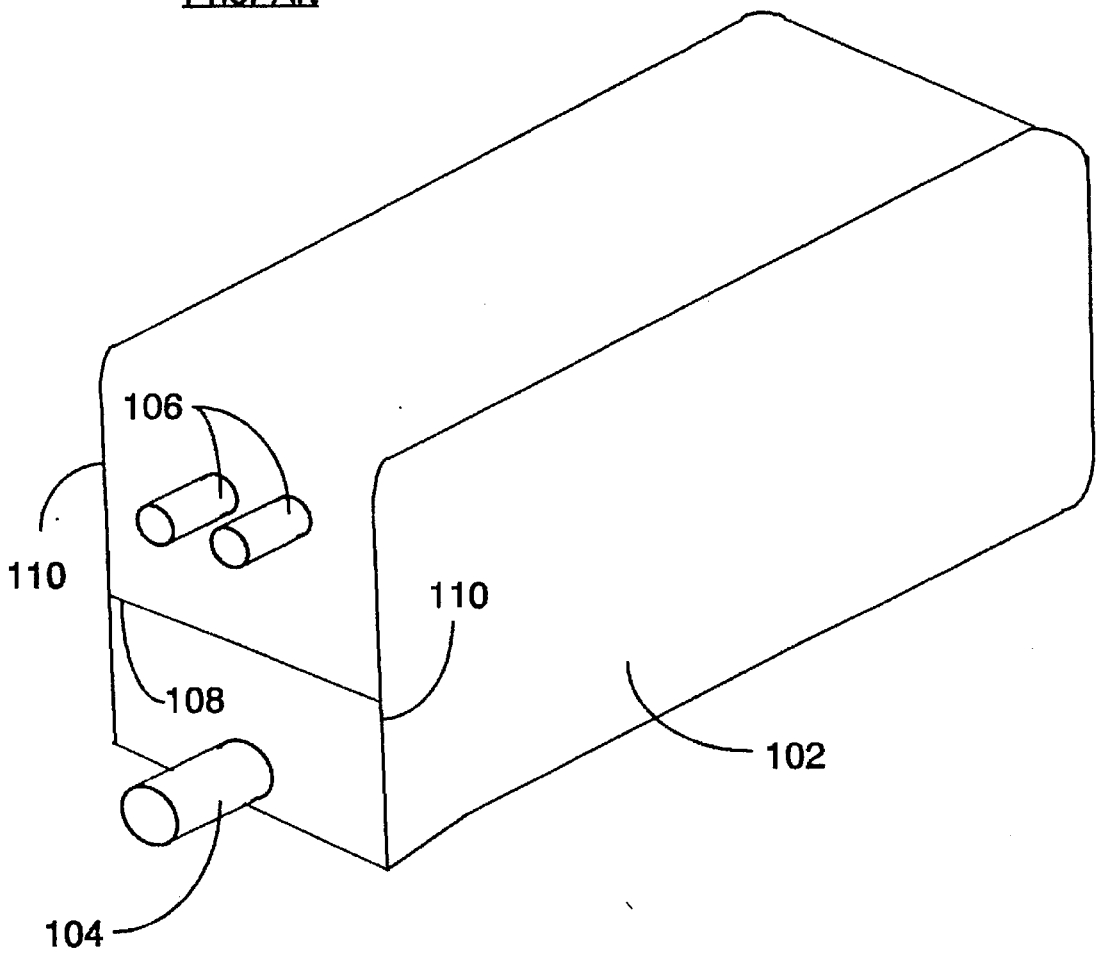
FIG. 1 is a diagram of a prior art liner.

Referring to FIG. 1, this figure shows a prior art liner 102. Load/vent tubes 106 form a conduit to access load/vent liner 102. The tubes are typically fabricated and attached to the liner 102 wall via heat seals. Discharge tube 104 is located to fit through discharge door 204 (shown in FIG. 2). It is also fabricated and attached in the same manner as load/vent tubes 106. Liner 102 is usually formed from a tube of liner material, typically polypropylene or polyethylene. The end of the tube is sealed during installation in a container by creating edge heat seals 110 and an end wall heat seal 108. After the end wall is fabricated, load, vent, and discharge tubes 104, 106 are fabricated from liner material via heat sealing and attached to the end wall of liner 102, also via heat sealing.

As expected, this method requires the expense of the heat sealing equipment, the additional time required to ensure that the seals 108, 110 are properly made, and the inherent safety risk associated with the heating equipment (not shown).

Figure 2:
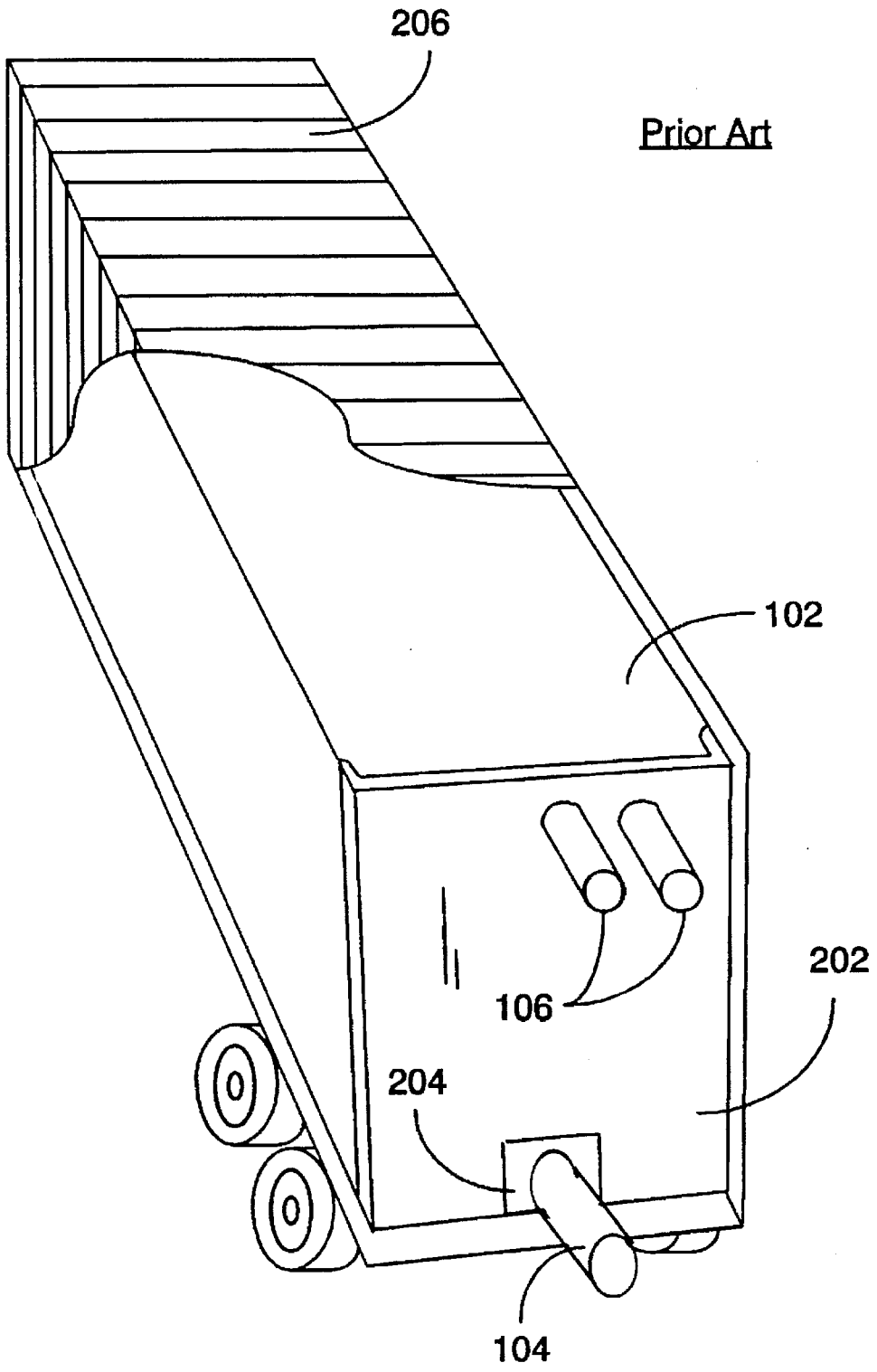
FIG. 2 is a diagram of a prior art liner installed in a container with a bulkhead.

FIG. 2 shows a prior art container 206 which has liner 102 installed. Bulkhead 202 has discharge door 204 located at its base to allow discharge of cargo from container 206 via discharge tube 104. Load/vent ports 106 project through apertures in bulkhead 202 the top of liner 102 to provide access for loading the cargo.

Figure 3A:
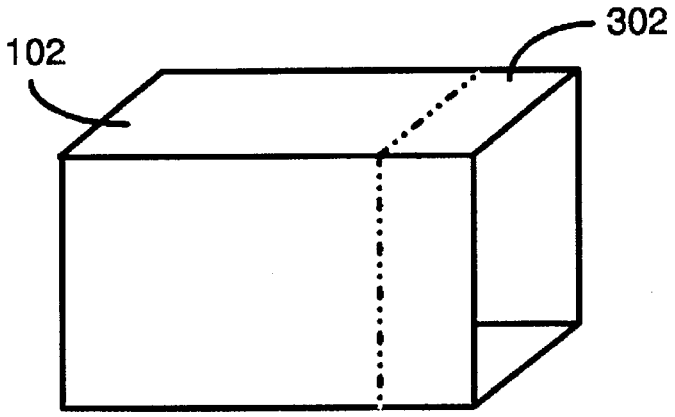
FIG. 3 is a diagram showing the steps used to construct the end wall of the liner.

FIG. 3 illustrates a method of fabricating liner 102 without heat sealing. For ease of discussion, the fabrication process for liner 102 and for ports 502 (shown below in FIG. 5) will be discussed in terms of fabrication on-site and prior to loading. However, those skilled in the art will recognize that a preferred embodiment of this invention is the use of prefabricated liners and prefabricated ports 502. In FIG. 3A, liner 102 has an open end. The material used to fabricate liner 102 is typically a flexible material such as 6 mil polyethylene or 6 mil polypropylene. Due to the flexibility, end portions 302 may be folded over to form an end wall.

Figure 3B:
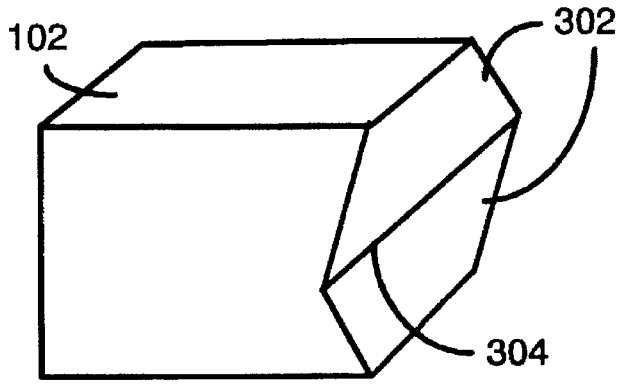

FIG. 3B shows the next step in the fabrication process, wherein end portions 302 are folded such that they overlap. The edges of end portions 302 are sealed via double stick tape to form wall tape seal 304.

Figure 3C:
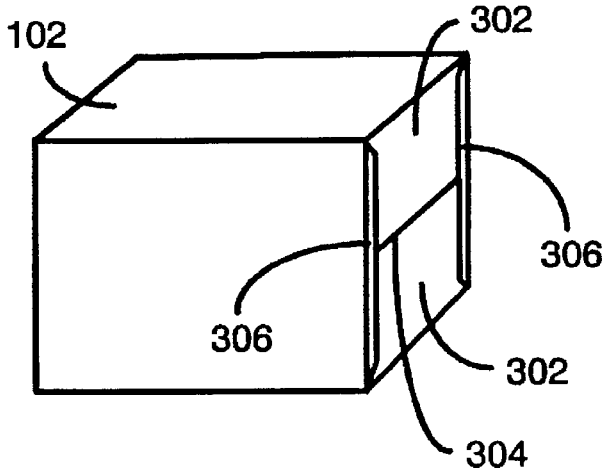

FIG. 3C shows the end seals 306 formed by folding the ends over the end wall of liner 102. The end seals 306 are formed with double stick tape in the same manner that wall tape seal 304 was formed. After sealing, excess material resulting from folding can be trimmed or taped against the wall of liner 102 as a reinforcing layer. Those skilled in the art will recognize that the location of wall tape seal 304 can vary in orientation or distance from a particular edge. Likewise, end seals 306 can be formed against the end wall of liner 102 or against the side wall of liner 102.

Figure 4:
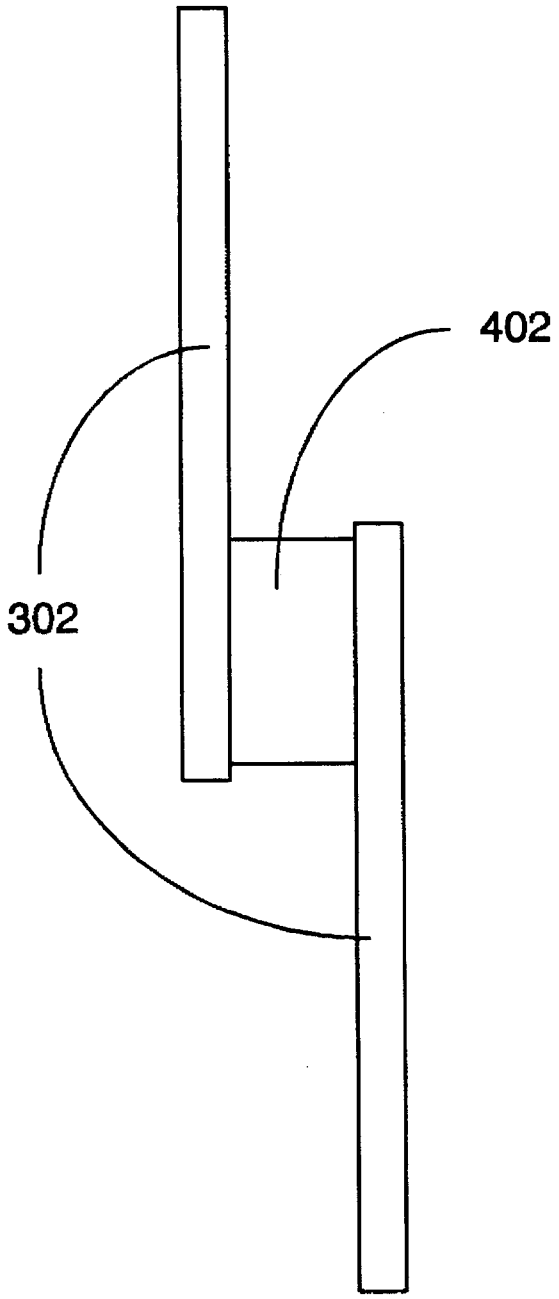
FIG. 4 is a diagram of a side view of the tape seal between overlapping layers of liner material.

FIG. 4 is a side view showing liner 102 end portions 302 overlapped and held together by tape 402 to form a seal. In the preferred embodiment, a woven double stick tape, such as that commonly used to hold carpeting to floors, has been found to provide a suitable seal. However, those skilled in the art will recognize that any number of commercially available double stick tapes, including fiberglass reinforced tapes, will perform adequately.

Figure 5A:
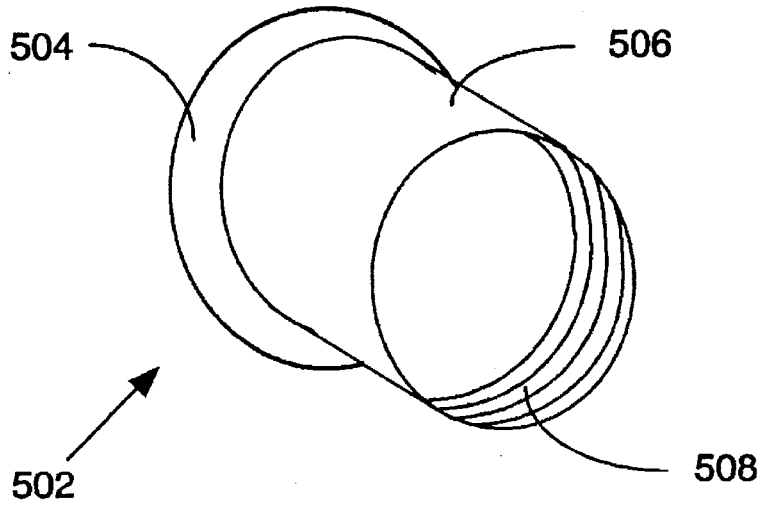
FIG. 5 is a diagram of a prefabricated load, vent or discharge port with tape seal attached.

FIG. 5A shows a prefabricated port 502 which can be used for loading, venting, or discharge of liner 102. In the preferred embodiment, a flange 504 is provided to increase the amount of tape sealing area available for attachment the wall or liner 102. Flange 504 joins conduit 506 which forms the body of port 502. Optional threads 508 are shown to illustrate a method of attaching a tube or other conduit to port 502 such that cargo may be unloaded via suction or pumping means (not shown). Those skilled in the art will recognize that any number of alternative methods may be used to attach a load, vent or discharge tube to port 502. Likewise, while port 502 is illustrated as a tubular structure, it can also be implemented in any convenient shape.

Figure 5B:
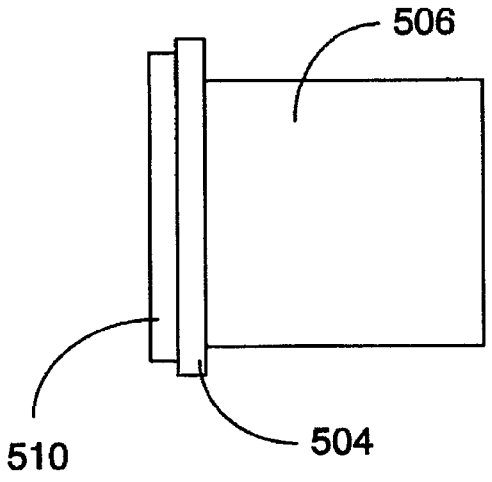

FIG. 5B shows a side view of port 502. In this view, double stick tape ring 510 is shown. Double stick tape ring 510 is pressed against the wall of liner 102 to form a seal and to hold port 502 in place against the wall of liner 102.

Figure 5C:
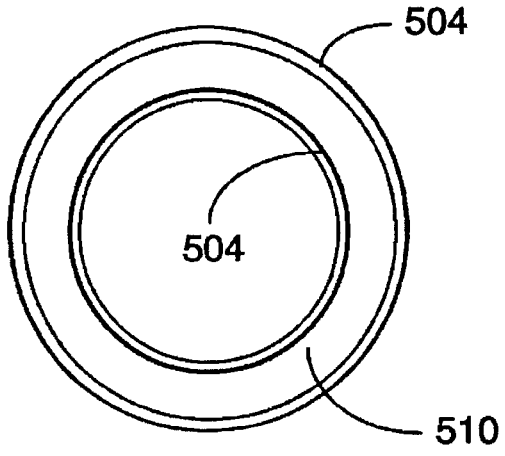

FIG. 5C shows an end view of port 502. In the preferred embodiment, the double stick tape 510 is precut and attached to flange 504 in such a manner that as much area as possible is available to form a seal with liner 102. Also, while the tape can be cut and installed on flange 504 during installation of port 502 on liner 102, the preferred embodiment envisions a precut ring of double stick tape 510 which is prefabricated onto port 502. In addition, the preferred embodiment envisions a peelable cover (not shown) attached to the outer surface of double stick tape 510. Those skilled in the art will recognize that any number of commercially available peelable cover materials can be used. By prefabricating port 502 with double stick tape 510, port 502 can be easily installed against the wall of liner 102 by peeling the cover and pressing port 502 against the wall of liner 102.

In addition to prefabricating port 502, if liner 102 is also prefabricated with covered strips of tape 402, then the entire liner 102 can be quickly installed by merely placing the liner 102 in position, folding end portions 302 into position, removing the covers from tape 402, and sealing the end wall of liner 102 together. The load, vent, discharge ports 502 can then be quickly attached in the same manner. Therefore, by providing prefabricated liners 102 and prefabricated ports 502, a substantial amount of time can be saved over prior art clamping and heat sealing methods during the loading process. In addition, the expense of clamps and heat sealing equipment is eliminated. Further, by providing the ability to attach the ports 502 to the wall of liner 102 as described, the wall of liner 102 does not have to be penetrated until the point of delivery. Delaying penetration of the wall of liner 102 in turn reduces the possibility of leakage. Those skilled in the art will recognize that while port 502 was shown as a rigid unit for ease of illustration, it could just as easily be constructed from any suitable flexible material, and take any convenient shape.

Figure 6A:
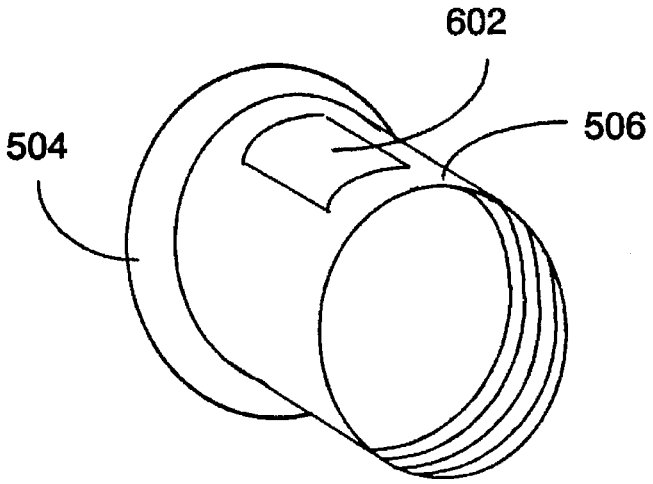
FIG. 6A is a perspective view of a load, vent, or discharge port (or flexible spout or sleeve) with an access door to allow access to remove the liner end wall after installation of the load, vent or discharge port.

FIG. 6A is an alternative embodiment of port 502. In this embodiment, an access door 602 is incorporated into the side of conduit 506 to allow access to the wall of liner 102 during the unloading process. The advantage of access door 602 is as follows. Without access door 602, the wall of liner 102 could only be penetrated by reaching in through the open end of port 502 to cut away a section of the liner 102 wall. To enable access in this manner, a discharge tube or conduit (not shown) could not be attached to port 502 until after the wall of liner 102 was breached. Due to this, some spillage would be expected during the unloading procedure. By providing access door 602, a discharge tube or conduit could be attached to port 502 prior to penetrating the wall of liner 102, and the aforementioned spillage would not result. After the liner 102 wall is penetrated, the access door can be closed.

Figure 6B:
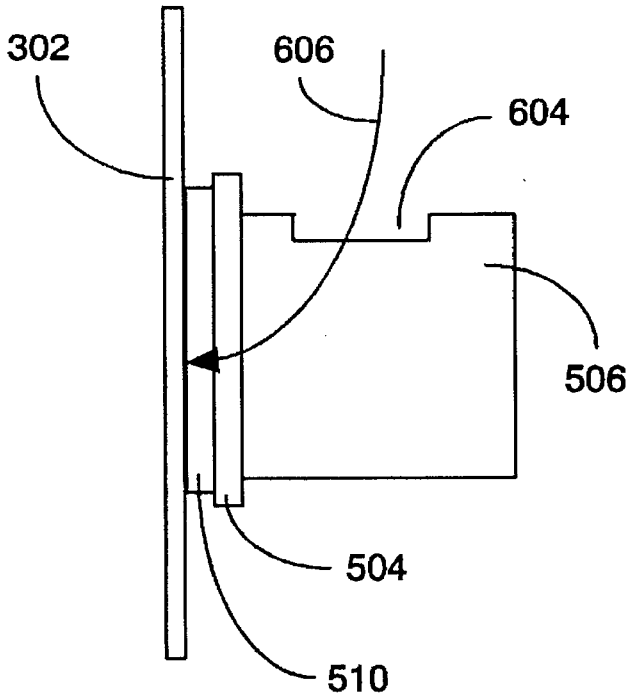
FIG. 6B is a side view of the load, vent, or discharge port of FIG. 6A attached to a liner end wall.

FIG. 6B shows a side view of port 502 with the opening 604 created by removal of access door 602. Port 502 is shown attached to liner 102 by double stick tape 510. Arrow 606 shows the access path used to reach the wall of liner 102 to effect the opening of the wall.

Figure 7:
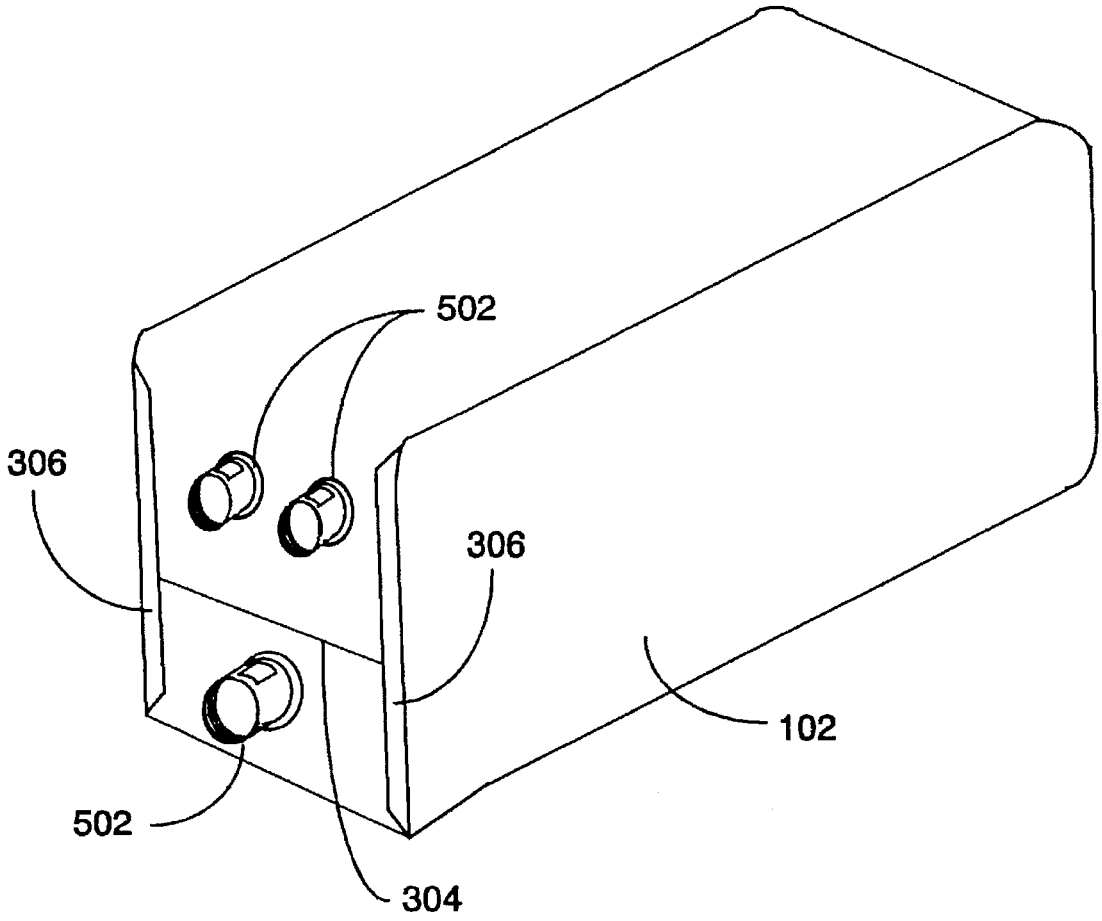
FIG. 7 show the preferred embodiment of the liner with attached load, vent, and discharge ports.

FIG. 7 illustrates a liner 102 fabricated using double stick tape to form seals 304, 306, and to attach ports 502.

Figure 8:
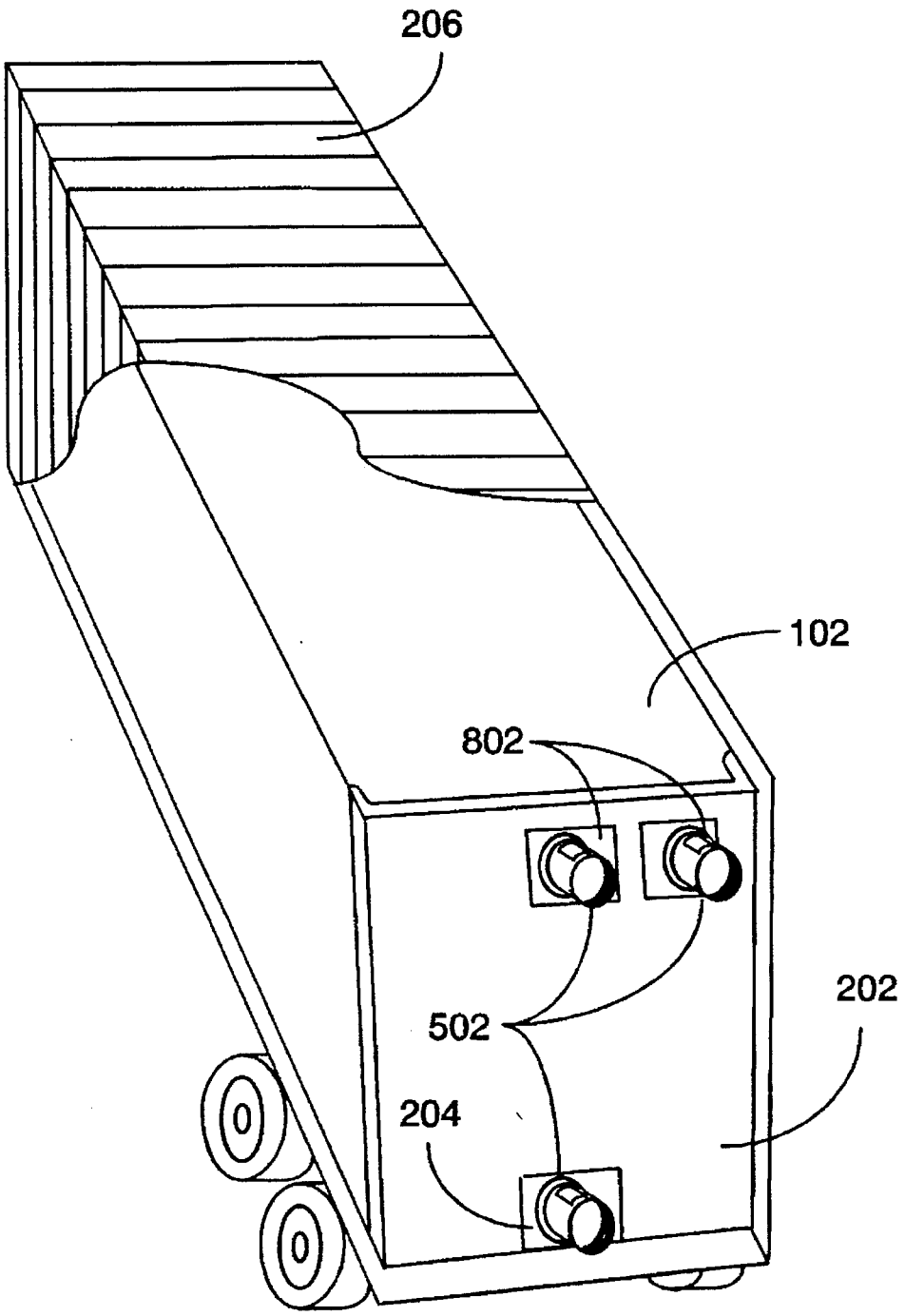
FIG. 8 is a perspective cutaway view of a lined container with attached load, vent, and discharge ports.

FIG. 8 illustrates a container 206 with a liner 102 formed by the method described herein. Ports 502 can be attached during the loading procedure or during the unloading procedure when the container reaches its destination.

Figure 9:
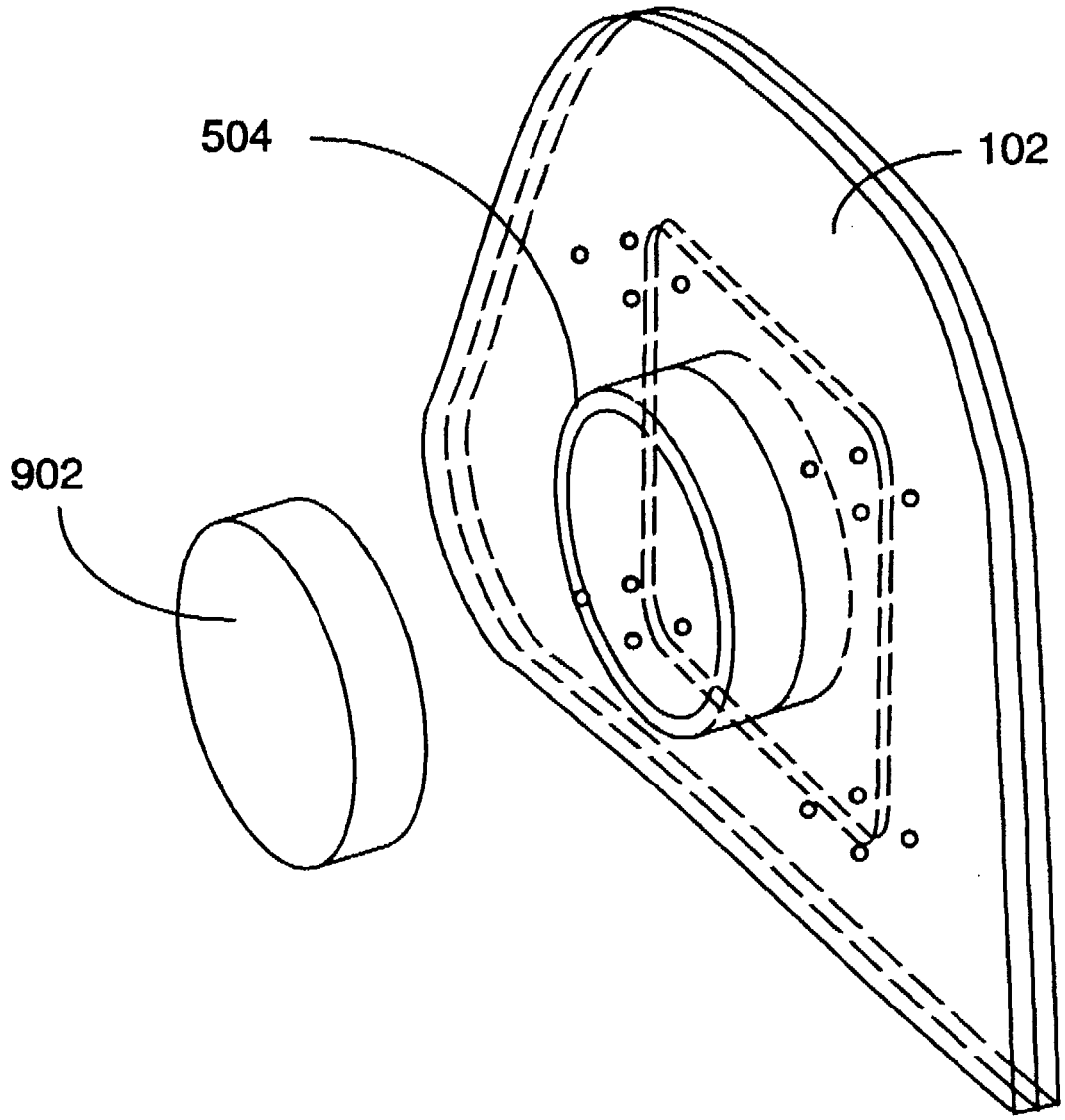
FIG. 9 is an alternative embodiment of a threaded fitting for use with the discharge control mechanism of FIG. 10.

FIG. 9 is an alternative embodiment in which the flange 504 is mounted to the bulkhead 202 independently of conduit 506. Cover 902 is provided to cover the exposed liner surface accessible through flange 504. Flange 504 can be mounted on bulkhead 202 as shown or mounted directly onto the surface of liner 102.

Figure 10:
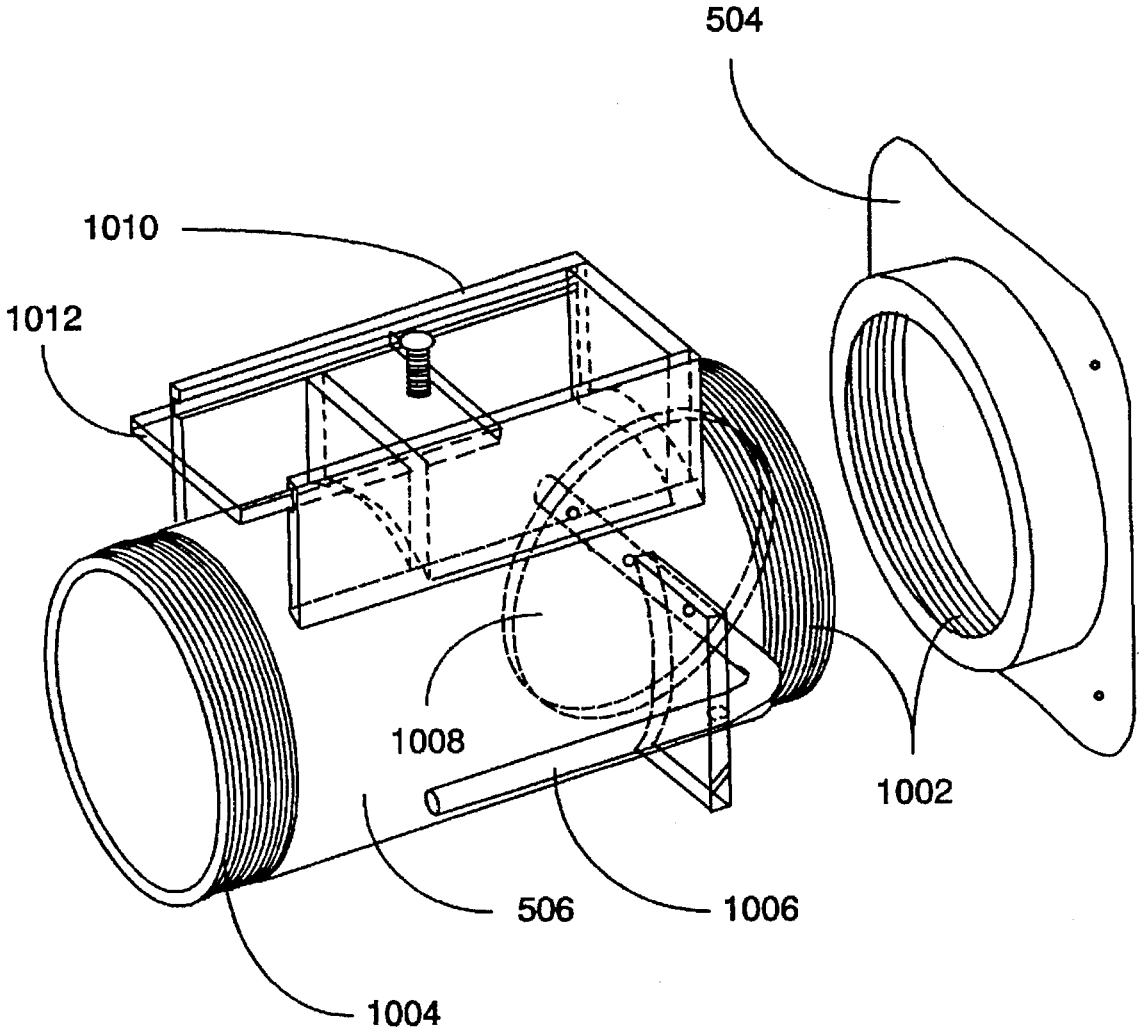
FIG. 10 is an alternative embodiment showing the discharge control mechanism used with the threaded fitting of FIG. 9.

FIG. 10 is an alternative embodiment of conduit 506. In this embodiment, conduit 506 and flange 504 are joined by threads 1002 during the cargo unloading process. Access frame 1010 has sliding door 1012 which allows a user to reach inside conduit 506 to cut the liner 102 exposed by flange 504. In the preferred embodiment, access frame 1010 and sliding door 1012 are made from transparent material to allow the inside of conduit 506 to be more readily viewed. Cargo flow control valve 1008 is opened by turning lever 1006 to allow entry of the user's hand to open the liner 102. After liner 102 is opened, cargo flow control valve 1008 is operated by lever 1006 to control the rate of discharge in conduit 506. Threaded end 1004 can be attached to a discharge hose to facilitate unloading. Of course, a variety of other methods may be used to attach a discharge hose to conduit 506 instead of using threaded end 1004.

While the invention has been described with respect to a preferred embodiment thereof, it will be understood by those skilled in the art that various changes in detail may be made therein without departing from the spirit, scope, and teaching of the invention. For example, the liner can be fabricated manually prior to loading, or it can be prefabricated in the form of a kit which allows even faster assemble. Ports can be fabricated from liner material or from rigid material, etc. Accordingly, the invention herein disclosed is to be limited only as specified in the following claims.

We claim:

1. A quick attachment port for rapid attachment of a discharge tube to a bulk container liner, comprising:

a port providing a path for bulk cargo, the port having a first aperture at a first end and a second aperture at a second end;

a double stick tape seal attached to a first end of the port, such that the first end of the port can be sealed to a wall of a liner by the double stick tape prior to unloading the container;

access means to allow opening of a portion of the liner wall which is surrounded by the first end of the port, the access means of a sufficient size to allow the liner wall to be accessed from outside the conduit; and discharge tube attachment means on the second end of the port;

whereby the bulk container liner can be rapidly prepared for unloading by attaching the port to a surface of a container liner.

2. A quick attachment port, as in claim 1, wherein the access means is the second aperture.

3. A quick attachment port, as in claim 1, wherein the access means further comprises an access door in the side of the conduit; the access door sufficiently large to allow a portion of the container liner surface to be removed after the port is attached to the surface of the container liner.

4. A quick attachment port, as in claim 3, wherein the port further comprises means to attach the second end of the conduit to a discharge tube.

* * * * *